United States Patent [19]

Jones

[11] Patent Number: 4,731,166

[45] Date of Patent: Mar. 15, 1988

[54] METHOD OF PRODUCING AN ADHERENT, SMOOTH DEPOSIT OF CHROMIUM ON A NODULAR IRON SUBSTRATE

[75] Inventor: Allen R. Jones, Belford, N.J.

[73] Assignee: M&T Chemicals Inc., Woodbridge, N.J.

[21] Appl. No.: 929,923

[22] Filed: Jan. 12, 1986

[51] Int. Cl.[4] ..... C25D 5/36

[52] U.S. Cl. ..... 204/34; 204/157.42; 204/129.1; 204/51

[58] Field of Search ..... 204/29, 34, 51, 157.42, 204/129.1

[56] References Cited

U.S. PATENT DOCUMENTS 2,744,860 5/1956 Rines ..... 204/157.42

*Primary Examiner*—R. L. Andrews

*Attorney, Agent, or Firm*—S. H. Parker; R. E. Bright

[57] ABSTRACT

An adherent, smooth electrodeposit of chromium is produced on a nodular cast iron substrate from a chromium plating bath. The desired deposit is provided herein by activating the substrate, subjecting the activated substrate to an ultrasonic treatment, and thereafter plating chromium from a chromium plating bath. The method is particularly effective for electrodeposition of chromium on such substrates from commercial high energy efficient chromium electroplating baths, where ordinarily only roughened deposits are obtained.

6 Claims, No Drawings

METHOD OF PRODUCING AN ADHERENT, SMOOTH DEPOSIT OF CHROMIUM ON A NODULAR IRON SUBSTRATE

BACKGROUND OF THE INVENTION

1. Field of the Invention

This invention relates to deposited layers of chromium, and, more particularly, to a method of making an adherent, smooth electrodeposit of chromium on a nodular cast iron substrate from a high energy efficient chromium plating path.

2. Description of the Prior Art

The use of high energy efficiency (HEEF) chromium plating processes has been hampered by the inability to obtain adequate coating adhesion and smoothness to certain basis metals. Such baths are of the types disclosed in Mitsui, J7B-33941 (September, 1978); U.S. Pat. Nos. 4,093,522; to Dillenberg, 4,234,396; to Perakh, and 4,450,050; 4,472,249 and 4,588,481 to Chessin.

Many activation treatments have been proposed for plating adherent chromium onto various substrates. For example, in order to obtain an adequate bond, as measured ASTM B 571-79, with typical chromium plating solutions, such as those using a solution of chromic acid and catalysts, such as sulfate, or sulfate in combination with various fluorides, the usual technique is to reverse or anodically etch a ferrous workpiece in the plating solution or in a separate chromium acid containing solution at a predetermined current density for a predetermined time.

A table which lists the time lengths for such an etching process is found in "Metal Finishing" 80 (5) 65-8 (1982) by C. H. Peger.

Anodic chromic acid treatments for 400 stainless steel alloys and for low and high carbon steels is disclosed in "48th Metal Finishing Guidebook-Directory" 78, 188–202 (1980) by A. Logozzo. Also recommended are cathodic treatments in sulfuric-fluoride solutions for 300 stainless, for nickel alloys and for cast iron.

Brune and McEnally in "Plating" 42, 1127–32 (1955) describe the use of magnesium sulfate acid anodic etch solution for preparing ferrous parts for plating. Similarly, ASTM Specification B-242-49T suggests the application of an anodic etch using a sulfuric acid solution containing sodium sulfate. ASTM B177-68 described the use of sulfuric acid or chromic acid as activators for chromium electroplating on steel for engineering use.

Chessin in U.S. Pat. No. 4,450,050 described an activation pretreatment for bonding high efficiency chromium electrodeposits on a metal substrate which is characterized by the step of first plating the substrate metal with iron or an iron alloy from an iron salt containing bath.

Hermann, in U.S. Pat. No. 4,416,758, activates metal substrates in an aqueous alkaline cyanide containing solution using current which is periodically reversed, followed by rinsing and chromium plating.

McMullen et al, in U.S. Pat. No. 4,585,530, describes an activation process using a substantially neutral solution of an alkali metal sulfate.

These and other activation solutions and procedures are intended to provide an adherent electrodeposit of chromium onto basis metal substrates. However, in the case of ferrous metal substrate, e.g. cast iron, which have a nodular or spheroidal structure, the activation or etching treatment still leaves a relatively non-uniform surface. Electrodeposition of chromium thereon thus produces a roughened surface layer. Furthermore, when such chromium layers are electrodeposited from a high energy efficient (HEEF-40 or HEEF-25) baths, such as the commercial HEEF baths based on U.S. Pat. Nos. 4,472,249 and 4,558,481, deposit builds up on the nodules and underlying portions of the substrate, producing a layer having a severely roughened surface.

Accordingly, it is an object of this invention to provide a method of producing an adherent, smooth deposit of chromium on a nodular or spheroidal ferrous metal substrate, such as cast iron, particularly an electrodeposit of chromium thereon from a high energy efficient (HEEF) plating bath.

Another object is to provide adherent, smooth deposits of chromium on such substrates using a wide range of different activation treatments.

A feature of the present invention is the application of an ultrasonic treatment on an activated nodular or spheroidal cast iron substrate whereby it can receive an adherent, smooth deposit of chromium thereon, particularly from a HEEF bath.

Another feature herein is that an ultrasonic treatment is effective to provide adherent, smooth deposits on such substrates with HEEF and other baths, using a wide range of different activation treatments.

SUMMARY OF THE INVENTION

What is described herein is a method of producing an adherent, smooth deposit of chromium on a nodular or sphercidal ferrous metal substrate from a chromium plating bath, which is characterized by first activating the substrate, then subjecting the activated substrate to an ultrasonic treatment, and finally plating chromium thereon deposit as an adherent, smooth layer.

In accordance with the invention, an adherent and smooth deposit of chromium on a nodular or spherical cast iron substrate is obtained from conventional chromium electrolytic baths, or from HEEF-25 and HEEF-40 baths, which are commercially available from M&T Chemicals Inc. (Rahway, N.J.). Any of the known substrates activation treatments for ferrous metals may be used on the nodular substrates herein in advance of or during the ultrasonic treatment.

Generally the ultrasonic treatment is carried out at about 15°–60° C., with or without a wetting agent. While it is preferred for the ultrasonic step to take place after activation, it may be performed during treatment of the substrate in the activation solution.

The invention now will be illustrated more particularly with reference to the following examples.

EXAMPLE 1

An activation solution was prepared from 40% v/v sulfuric acid, 0.5 g/l sodium nitrate and 100 g/l magnesium sulfate heptahydrate. A nodular cast iron substrate was placed in the solution at 15° C. and anodically etched at 77.5 amps/dm2 for 15 seconds. After rinsing, the activated substrate was placed in an ultrasonic tank generating 40 watts per gallon, at 25,000 Hertz, such as the Branson Ultrasonic Transducer-Model A-3000, for 30 seconds at 55° C. The treated substrate then was electroplated in a commercial high energy efficient chromium electroplating bath (HEEF-40) for 1 hour at 55° C. at 75 amps/dm$^2$. A deposit of chromium having a thickness of about 25 microns was obtained which was an adherent and smooth deposit.

EXAMPLE 2

An activation solution was prepared from 30% v/v sulfuric acid, 24 g/l sodium dichromate dihydrate and 200 g/l magnesium sulfate heptahydrate. A nodular cast iron substrate was placed in the solution and made anodic for 2 minutes at 15.5 amps/dm$^2$ at 25° C. Thereafter the substrate was made cathodic and etched for 1 minute. After rinsing, the activated substrate was placed in the ultrasonic bath, treated and plated as in Exmaple 1. The deposited chromium was adherent and smooth.

EXAMPLE 3

The activation solution consisted of 180 g/l sodium sulfate, 0.5 g/l of a wetting agent (Petro BA) and 20 g/l sodium tetraborate decahydrate (pH 7.0). Activation was carried out anodically for 2 minutes at 77.5 amps/dm$^2$ at 20° C. Ultrasonic treatment was effected as in Example 1. Adherent, smooth chromium deposits were obtained when chromium was electroplated on the treated substrate from a conventional chromic acid-sulfuric acid electroplating bath.

EXAMPLE 4

The activation solution consisted of 250 g/l chromic acid. Activation was carried out anodically at 60° C. for 1 minute at 77.5 amps/dm$^2$. After rinsing, the activated substrate was ultrasonically treated for 1 minute at 60° C. in water containing 0.1% of a wetting agent. The thus-treated substrate was electroplated with chromium from a commercial HEEF-25 plating bath to provide an adherent, smooth deposit of chromium at a thickness of 24 microns.

While the invention has been described with particular reference to certain embodiments thereof, it will be understood that changes and modifications may be made which are within the skill of the art. Accordingly, it is intended to be bound, only by the appended claims, in which:

I claim:

1. A method of producing an adherent, smooth deposit of chromium on a nodular ferrous substrate which comprises the step of a. activating said substate with an activation solution to loosen the nodules, b. then treating said activated substrate in water by applying ultrasonic energy to remove the loosened nodules, c. then electroplating chromium thereon to produce said desired chromium deposit.

2. A method according to claim 1 wherein activation is carried out electroplating.

3. A method according to claim 2 wherein said ultrasonic energy is applied at a temperature of about 15° to 60° C.

4. A method according to claim 2 wherein said high energy efficient chromium electroplating bath is a HEEF-40 or HEEF-25 bath.

5. A method according to claim 2 wherein said electrolytic activation is anodic etching at 15.5 to 155 amps/dm$^2$ at 20°–70° C. for 0.1 to 5 minutes.

6. A method according to claim 2 wherein said activation solution is selected from solutions of (a) sulfuric acid an alkali metal dichromate and magnesium sulfate, (b) sulfuric acid, an alkali metal nitrate and mangesium sulfate, (c) an alkali metal sulfate at pH of about 7, and (d) chromic acid.

* * * * *